US008235882B2

(12) United States Patent
Reiff

(10) Patent No.: US 8,235,882 B2
(45) Date of Patent: Aug. 7, 2012

(54) DECANTER CENTRIFUGE WITH A HINGED LID

(75) Inventor: Henrik Reiff, Farum (DK)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 13/130,690

(22) PCT Filed: Nov. 17, 2009

(86) PCT No.: PCT/DK2009/050305

§ 371 (c)(1),
(2), (4) Date: Sep. 15, 2011

(87) PCT Pub. No.: WO2010/060432

PCT Pub. Date: Jun. 3, 2010

(65) Prior Publication Data

US 2012/0010065 A1 Jan. 12, 2012

(30) Foreign Application Priority Data

Nov. 28, 2008 (DK) ..... 2008 01681

(51) Int. Cl.
*B04B 7/02* (2006.01)

(52) U.S. Cl. ..... 494/53; 494/60; 49/386

(58) Field of Classification Search ..... 494/50–55, 494/60, 43, 61, 85; 210/360.1–380.3; 49/386
See application file for complete search history.

(56) References Cited

U.S. PATENT DOCUMENTS

| | | | | | |
|---|---|---|---|---|---|
| 1,357,655 | A | | 11/1920 | Sandell | |
| 2,777,157 | A | | 1/1957 | Burke | |
| 2,923,430 | A | * | 2/1960 | Stengele | 220/264 |
| 3,096,282 | A | * | 7/1963 | Trotter, Jr. | 494/45 |
| 3,398,888 | A | * | 8/1968 | Koenecke et al. | 494/11 |
| 3,428,248 | A | * | 2/1969 | Andresen et al. | 494/42 |
| 3,474,955 | A | * | 10/1969 | Lang et al. | 494/13 |
| 3,575,709 | A | * | 4/1971 | Ferney | 127/56 |
| 3,643,291 | A | | 2/1972 | Clark | |

(Continued)

FOREIGN PATENT DOCUMENTS

DE 1091043 10/1960

(Continued)

OTHER PUBLICATIONS

Search Report from Danish Patent Application No. PA 2008 01681.

*Primary Examiner* — Charles E Cooley
(74) *Attorney, Agent, or Firm* — Michaud-Kinney Group LLP

(57) ABSTRACT

A centrifuge housing has a lid with a hinge with two hinge parts and a horizontal hinge axis. The lid is able to rotate between a closed position, in which the lid's centre of gravity is positioned on one side of a vertical plane through the hinge axis, and a fully opened position, in which the centre of gravity is positioned on the other side of the vertical plane. A longitudinal spring is connected to a connection member for urging it longitudinally. The connection member is connected at a hinge point at a distance from the hinge axis. The spring assists raising the lid initially during opening and closing the lid initially during closing from the fully opened position. The lid has a position of stable equilibrium in an intermediate position between the closed position and a vertical position.

12 Claims, 10 Drawing Sheets

U.S. PATENT DOCUMENTS

| | | | | | |
|---|---|---|---|---|---|
| 3,802,621 | A | * | 4/1974 | Merzenich | 494/29 |
| 3,932,941 | A | * | 1/1976 | Ormsby | 73/7 |
| 4,037,781 | A | * | 7/1977 | High | 494/51 |
| 4,120,447 | A | * | 10/1978 | Jager | 494/14 |
| 4,124,296 | A | | 11/1978 | Kishi et al. | |
| 4,251,023 | A | * | 2/1981 | Hohne et al. | 494/60 |
| 4,298,161 | A | * | 11/1981 | Ephithite | 494/15 |
| 5,067,938 | A | * | 11/1991 | Uchida et al. | 494/12 |
| 5,205,073 | A | * | 4/1993 | Lyons, Sr. | 49/386 |
| 5,240,319 | A | | 8/1993 | Koga | |
| 5,361,926 | A | * | 11/1994 | Messner | 494/38 |
| 5,502,342 | A | | 3/1996 | Feldkamp et al. | |
| 6,021,606 | A | * | 2/2000 | Kos | 49/386 |
| 6,248,055 | B1 | * | 6/2001 | Ostkamp | 494/60 |
| 6,290,636 | B1 | * | 9/2001 | Hiller et al. | 494/53 |
| 6,296,142 | B1 | | 10/2001 | Nguyen | |
| 7,815,560 | B2 | * | 10/2010 | Hayasaka et al. | 494/60 |
| 8,021,289 | B2 | * | 9/2011 | Vastola et al. | 494/29 |
| 2007/0072759 | A1 | * | 3/2007 | Hayasaka et al. | 494/60 |
| 2008/0078123 | A1 | | 4/2008 | Wei | |
| 2012/0010065 | A1 | * | 1/2012 | Reiff | 494/60 |

FOREIGN PATENT DOCUMENTS

| | | | | |
|---|---|---|---|---|
| DE | 4315694 | A1 | | 11/1994 |
| EP | 0 300 669 | | | 1/1989 |
| EP | 0300669 | A1 | | 1/1989 |
| JP | 2008-168253 | A | * | 7/2008 |
| WO | 0196767 | | | 12/2001 |
| WO | WO0196767 | | | 12/2001 |
| WO | WO 2010060432 | A1 | * | 6/2010 |

* cited by examiner

DECANTER CENTRIFUGE WITH A HINGED LID

FIELD OF THE INVENTION

The present invention relates to a centrifuge comprising a drum with an axis of rotation and a housing for the drum, said housing comprising a lower part and a lid, the lid being attached to the lower part by at least one hinge comprising two hinge parts one of which is connected to the lid and one of which is connected to the lower part, said hinge having a horizontal hinge axis, whereby the lid is able to rotate around the hinge axis between a closed position, in which a centre of gravity of the lid is positioned on a proximal side of a vertical plane through the hinge axis, and a fully opened position, in which the centre of gravity is positioned on a distal side of the vertical plane through the hinge axis, the lid being provided with a handle for manually opening the lid, at least one spring unit being attached to the hinge for assisting raising of the lid during opening, the spring unit being a longitudinal spring unit having a longitudinal direction, the spring unit being connected to a connection member for urging the connection member in the longitudinal direction, the connection member being connected to one of the hinge parts at a hinge point at a distance from the hinge axis, the spring unit having a neutral extension in which it is not urging the connection member in the longitudinal direction, when the lid is in an intermediate position between its closed position and its fully opened position, the spring unit being stressed away from its neutral extension to urge the connection member in the longitudinal direction and thus the lid in a direction towards the fully opened position, when the lid is in the closed position.

A drive is attached to the centrifuge or the centrifuge comprises a drive for rotating the drum.

BACKGROUND

Decanter centrifuges comprise a drum rotatable in a housing comprising a lower part and a lid, which is normally cylindrically dome-shaped. The lid may be hinged to the lower part along a side thereof.

Alternatively to hinging the lid to the lower part, the lid may be provided as a free part to be lifted from the lower part for opening the housing, possibly using a crane if the lid is heavy.

It should be noted that lids of decanter centrifuges may weigh more than 60 kg, e.g. 300 kg or even more, depending on the size of the centrifuge.

For decanter centrifuges with a hinged lid it is known to provide springs for assisting the raising of the lid during opening.

It should be noted that the lid of a decanter centrifuge is normally opened once a week or once every second week for cleaning and/or maintenance. The duration of the intervals between opening the lid depends however on the use of a specific centrifuge. Thus some centrifuges may be opened daily.

A decanter centrifuge of a generally known construction is shown schematically in FIGS. 1 and 2, and a known hinge with an opening assisting one-way spring is schematically shown in FIG. 3. The Figures are explained below.

A hinge with an opening assisting spring as shown in FIG. 3 has proven to be a good solution for lids up a certain size. However it has not proven possible to provide a satisfactory solution on the basis of the construction shown in FIG. 3 for a lid with a weight of 300 kg.

One object of the present invention is to provide a centrifuge with a hinge with an opening assisting spring unit that will provide a satisfactory solution for heavy lids, that can, but are not limited to weigh 300 kg or more.

According to the present invention a connection member is connected to the spring unit to stress it during at least a final part of the lid's rotation around the hinge axis to the fully opened position, whereby the spring unit will urge the lid through the connection member in a direction from the fully opened position towards the closed position, when the lid is in the fully opened position, and that the lid has a position of stable equilibrium in an intermediate position of the lid between the closed position and an open, sometimes substantially vertical position, in which the centre of gravity is positioned substantially vertically above the hinge axis. Providing for the spring unit to urge the lid from the fully opened position towards the closed position provides for the spring unit to also assist closing the lid from the fully opened position, in which the lid tends to stay open due to the fact that the centre of gravity of the lid in this open position is located on the distal side of the vertical plane through the hinge axis, and it provides for the spring unit to catch the lid as its centre of gravity passes the vertical plane through the hinge axis and the lid tends to fall backwards. Further the position of stable equilibrium provides for the lid to stay in a position in which the centre of gravity has passed from the distal side to the proximal side of the vertical plane through the hinge axis without having to fall to the closed position, which provides for safer and more controlled operation by an operator.

In one embodiment the centrifuge is a decanter centrifuge and the drum has a horizontal axis of rotation.

Preferably, the lower part comprises a sealing surface and the lid comprises a sealing surface extending along a rim of the lid, the two sealing surfaces being in engagement when the lid is in the closed position, and preferably a number of fasteners are provided along the rim of the lid for securing the lid in the closed position and for pressing the sealing surfaces against each other.

Preferably, at least a part of the connection member connected to the hinge part is shiftable between limits relative to a force transferring interface between the connection member and the spring unit when the spring unit is in a position, in which it has its neutral extension. This provides for a dead band interval within which the lid will rotate without being urged by the spring unit, which facilitates construction and dimensioning of the spring unit and the elements mounting it.

In a preferred embodiment, a vertical plane parallel to the hinge axis and passing through the hinge point is, when the lid is in its closed position, located between the centre of gravity of the lid and the hinge axis, and the hinge allows limited vertical movement of the lid in the closed position. This embodiment is particularly advantageous when a gasket on the lid provides one of the sealing surfaces. In this embodiment, the gasket is not compressed by the lid rotating from an open to the closed position, but is only compressed when the fasteners are secured. Thus, an effect of the pressure of the gasket opening the lid the first 5-10° from the closed position is avoided.

In a further embodiment the spring unit is a mechanical spring unit, the connection member extends beyond a longitudinal extension of the spring unit, the spring unit is confined at its longitudinal ends between first abutments, which are fixed relative to the second of the hinge parts, and the connection member comprises second abutments for compressing the spring unit from either longitudinal end thereof. Accordingly, the spring unit will be compressed when the lid is rotated away in either direction from a neutral position e.g. at the vertical position mentioned above.

In a preferred embodiment, the mutual distances between the first abutments and the second abutments, respectively, are different. This feature provides for a dead band interval as mentioned above.

In a further embodiment, the spring unit is hollow, and the connection member extends through the spring unit.

In a preferred embodiment, the spring unit comprises a stack of Belleville washers. Using Belleville washers provides for more easily obtaining the desired characteristic of the spring unit.

In a further embodiment, a washer element is provided at one of the longitudinal ends of the spring unit, the spring unit abutting the washer element, the connection member is passing through the washer element, the connection member being longitudinally slidable relative to the washer element, the second abutment is engageable with the washer element, and a stop is provided restricting movement of the washer element in a longitudinal direction away from the spring unit, the stop thus providing a first abutment.

Preferably, a washer element is provided at either longitudinal end of the spring unit. This provides for the above mentioned effect of compressing the spring unit when the lid is rotated in either direction from a neutral position.

In a preferred embodiment, the washer element at the longitudinal end of the spring unit opposite the hinge point is movable in the longitudinal direction between two stops. Thus a stop is provided for the opening movement of the lid establishing the fully opened position.

In an alternative embodiment the connection member is connected to a piston of a pneumatic or hydraulic cylinder assembly providing the spring unit.

BRIEF DESCRIPTION OF THE DRAWINGS

The invention will in the following be explained in further detail by way of examples of embodiments with reference to the schematic drawing, in which.

DETAILED DESCRIPTION

Figure 1:
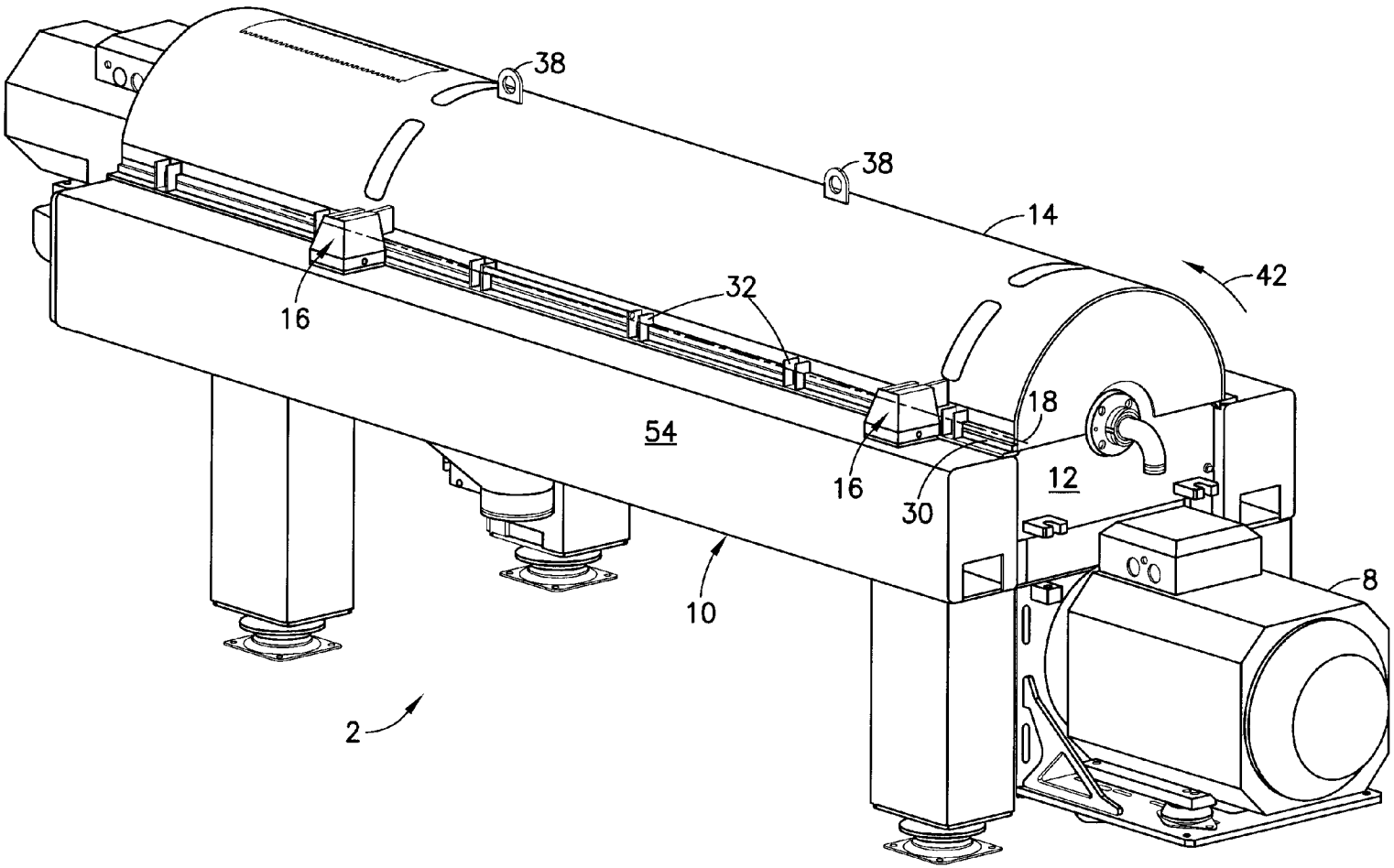
FIG. 1 is a oblique view of a decanter centrifuge with its lid closed, FIG. 2 an oblique view of the decanter centrifuge of FIG. 1 showing the opposite side and the lid open.
Figure 2:
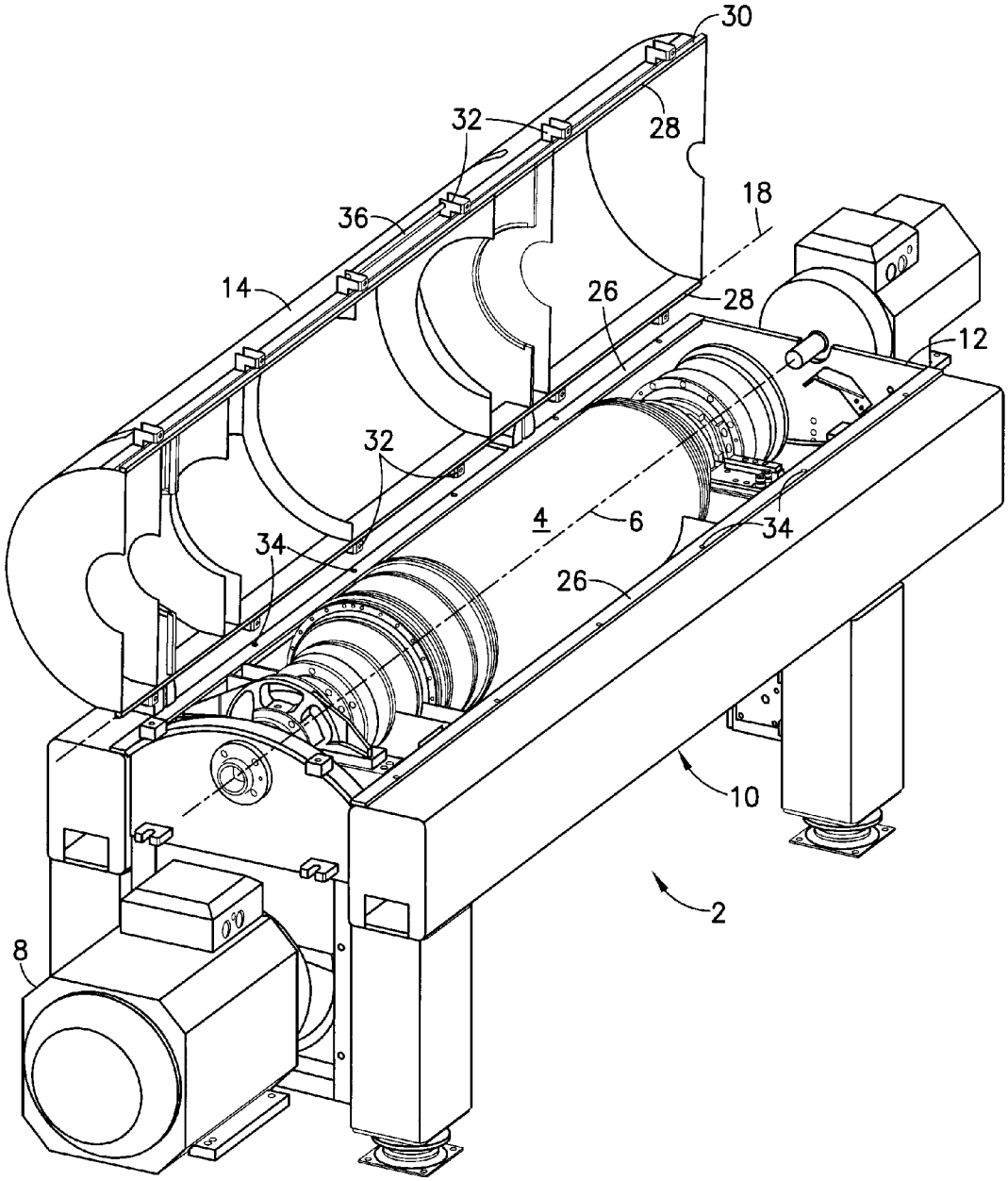

FIGS. 1 and 2 show a decanter centrifuge 2 comprising a drum 4 with a horizontal axis 6 of rotation, a drive 8 for rotating the drum 4 and a housing 10 for the drum 4. The housing 10 comprising a lower part 12 and a lid 14, which is attached to the lower part 12 by two hinges 16 with a horizontal hinge axis 18.

Figure 4:
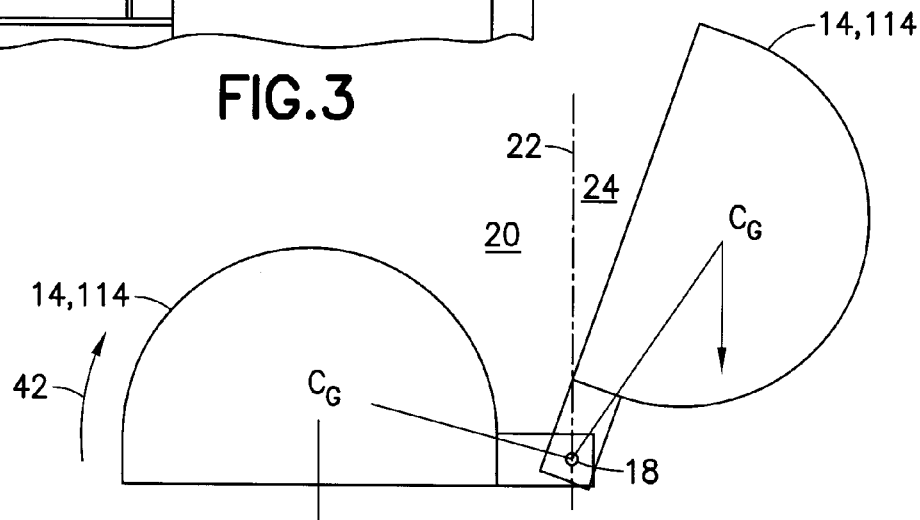
FIG. 4 is a schematic end view of the lid in closed and fully opened position.

By means of the hinges 16 the lid 14 is able to rotate around the hinge axis 18 between a closed position shown in FIG. 1 and an open position (in which the lid 14 is fully opened) shown in FIG. 2. As indicated in FIG. 4, in the closed position the centre of gravity $C_G$ of the lid 14 is positioned on a proximal side 20 of a vertical plane 22 through the hinge axis 18, and in the open position the centre of gravity $C_G$ is position on a distal side 24 of the vertical plane 22 through the hinge axis 18. This means that in the closed position gravity tends to rotate the lid 14 in one direction, and in the open position gravity tends to rotate the lid in the opposite direction.

The lower part 12 comprises a sealing surface 26 and the lid 14 comprises a sealing surface 28 provided by a gasket extending along the rim 30 of the lid 14. The two sealing surfaces 26, 28 are in engagement when the lid 14 is in the closed position. A number of fasteners are provided along the rim 30 of the lid 14 for securing the lid 14 in the closed position and for pressing the sealing surfaces 26, 28 against each other. The fasteners are in the form of brackets 32 with holes for receiving screws to be screwed into holes 34 next to the sealing surface 26 of the lower part 12.

The lid 14 is provided with a handle 36 for manually opening the lid, when the fastening screws are removed, and the lid 14 is provided with rings 38 for lifting the lid 14 by means of e.g. a crane.

As described so far the decanter centrifuge is of a kind known per se.

Figure 3:
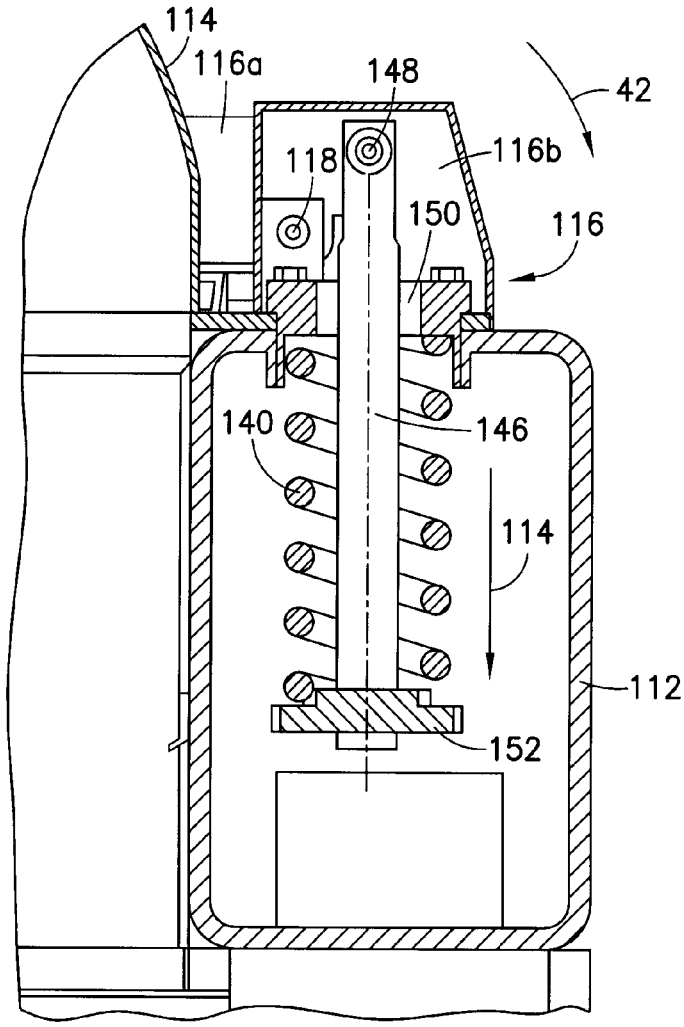
FIG. 3 shows a prior art hinge and spring construction.

As the lid 14 may be heavy a spring 140 is in a known hinge construction, shown in FIG. 3, attached to the hinge 116 for assisting raising of the lid 114 during opening. The spring 140 urges the lid 114 in a direction 42 from the closed position towards the open position, when the lid is in the closed position. The spring 140 is a linear coil spring with a longitudinal direction 144.

The hinge 116 comprises two hinge parts **116*a* and 116*b* interconnected to be mutually rotatable around the hinge axis 118. One hinge part 116*a* is connected to the lid 114, and the other hinge part 116*b* is connected to the lower part 112. A connection member in the shape of a rod 146 is rotatably connected to the first hinge part 116*a* at a hinge point 148 at a distance from the hinge axis 118. The rod 146 extends downward from the hinge point 148 through a hole 150 in the lower part 112, through the coil spring 140, which abuts the edges along the hole 150, to be received in and fastened to a washer element 152 abutting the lower end of the spring 140**.

As shown in FIG. 3 the lid 114 is in its closed position. When the lid is raised it will rotate in the clockwise direction and the spring 140, which is compressed when the lid is in the closed position, will extend and tend to push down the washer element 152 and the rod 146 thereby imposing a torque assisting the raising of the lid 114. When the lid 114 reaches a certain position the spring reaches its neutral or relaxed position. Further movement of the lid will not be accompanied by further extension of the spring 140.

Referring now to FIGS. 5 to 9 a hinge 16 according to the present invention comprises two hinge parts **16*a* and 16*b* whereof the first hinge part 16*a* is attached to the lid (not shown in FIGS. 5 to 9, but to be understood as being placed to the left of the respective FIGS.) and the second hinge part 16*b* is attached to a hollow beam 54 of the lower part 12. The second hinge part 16*b* comprises a horizontal flat member 56 with an elongate hole 50 and a flange 58 rising vertically from the flat member 56. The flange 58 carries a pivot 60 defining the hinge axis 18. The pivot 60 extends through an elongate hole 62 in the first hinge part 16*a***, whereby the first hinge pat

16*a* is able to rotate relative to the second hinge part 16*b* and to be shifted relative thereto, as it will be described below.

A connection member in the shape of a rod 46 is connected rotatably to the first hinge part 16*a* at a hinge point 48. As it appears from FIG. 5 a vertical plane 49 through the hinge point IS, when the lid is in its closed position as it should be understood to be in the FIG. 5-*situation*, placed between the hinge axis 18 and the lid. A cylindrical housing 64 extends downward from the flat member 56 to accommodate a spring unit or spring 40, which in the present embodiment is a stack of Belleville washers. An upper washer element 66 is provided at the top of the spring 40, and a lower washer element 68 is provided at the bottom of the spring 40 to confine the spring. The lower washer element 68 is movable in a substantially vertical direction between upper and lower retainer rings 70*a* and 70*b* such as, but not limited to Seeger rings. The upper washer element 66 has a diameter allowing it to rest against longitudinal side edges of the elongate hole 50 at the lower side thereof. The rod 46 is recessed to provide at an upper end of the rod a shoulder at which an upper retaining washer 72 is fixed. At a lower end of the rod 46 a lower retaining washer 74 is fastened by means of a screw 76. The washer elements 66 and 68 and the spring 401.*e*. the Belleville washers may be shifted along the rod 46 between the two retaining washers 72 and 74.

The above-described decanter centrifuge lid 14 with the hinge 16 works in the following way:

When the lid is in its closed position (FIG. 5) the rod 46 is in a low position compressing the spring 40 through the upper retaining washers 72 abutment against the upper washer element 66, the lower end of the spring 40 and the lower washer element 68 being retained by the lower retainer ring 70*b*. Thus the spring 40 urges the lid 14 through the first hinge part 16*a*, the rod 46, which is urged in a longitudinal direction 44 of the spring, the upper retainer washer 72, and the upper washer element 66, in a direction 42 towards its open position.

Figure 10:
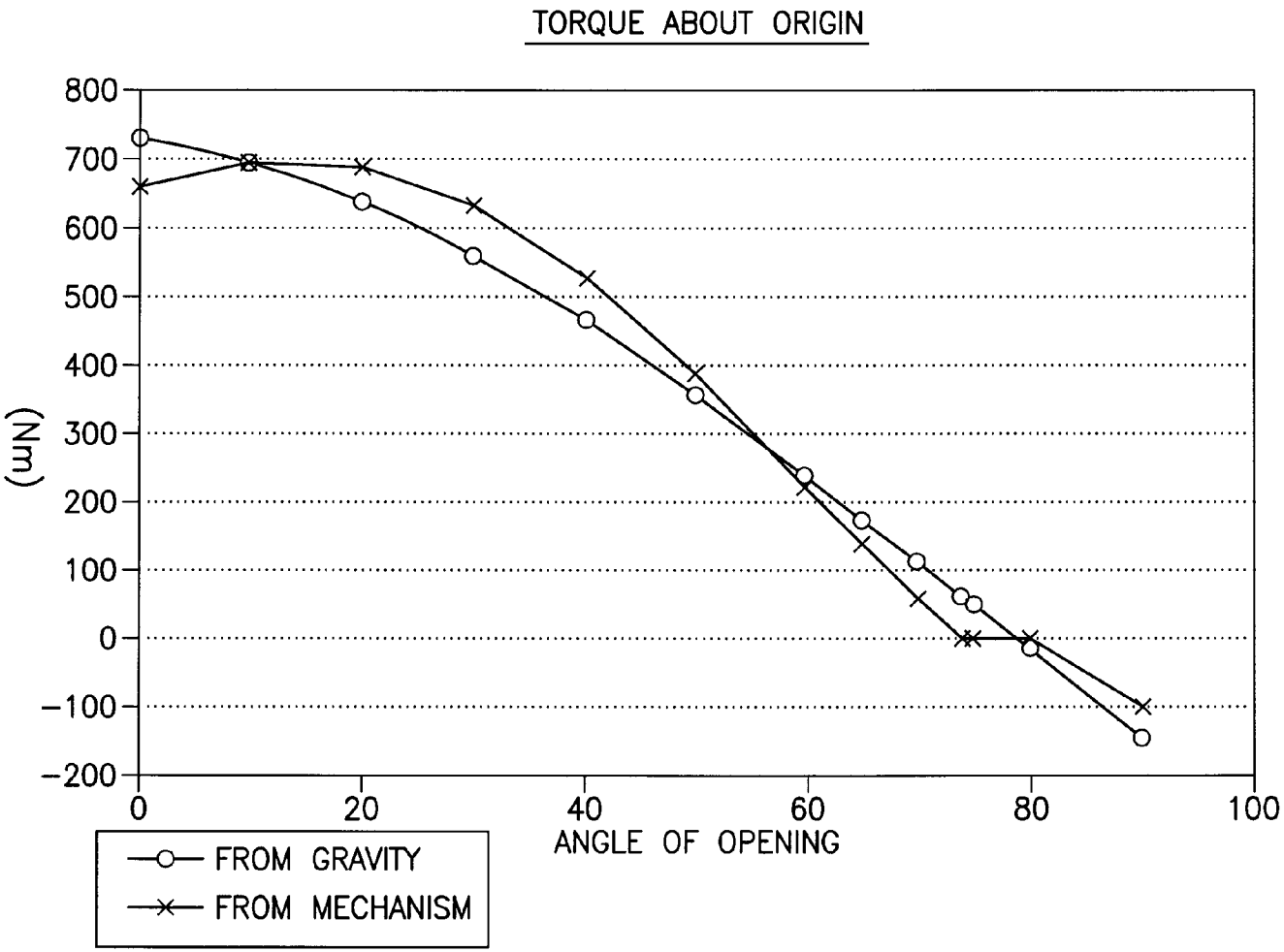
FIGS. 10 and 11 show as examples diagrams of the torque affecting the lid due to gravity and the spring as a function of the opening angle.
Figure 11:
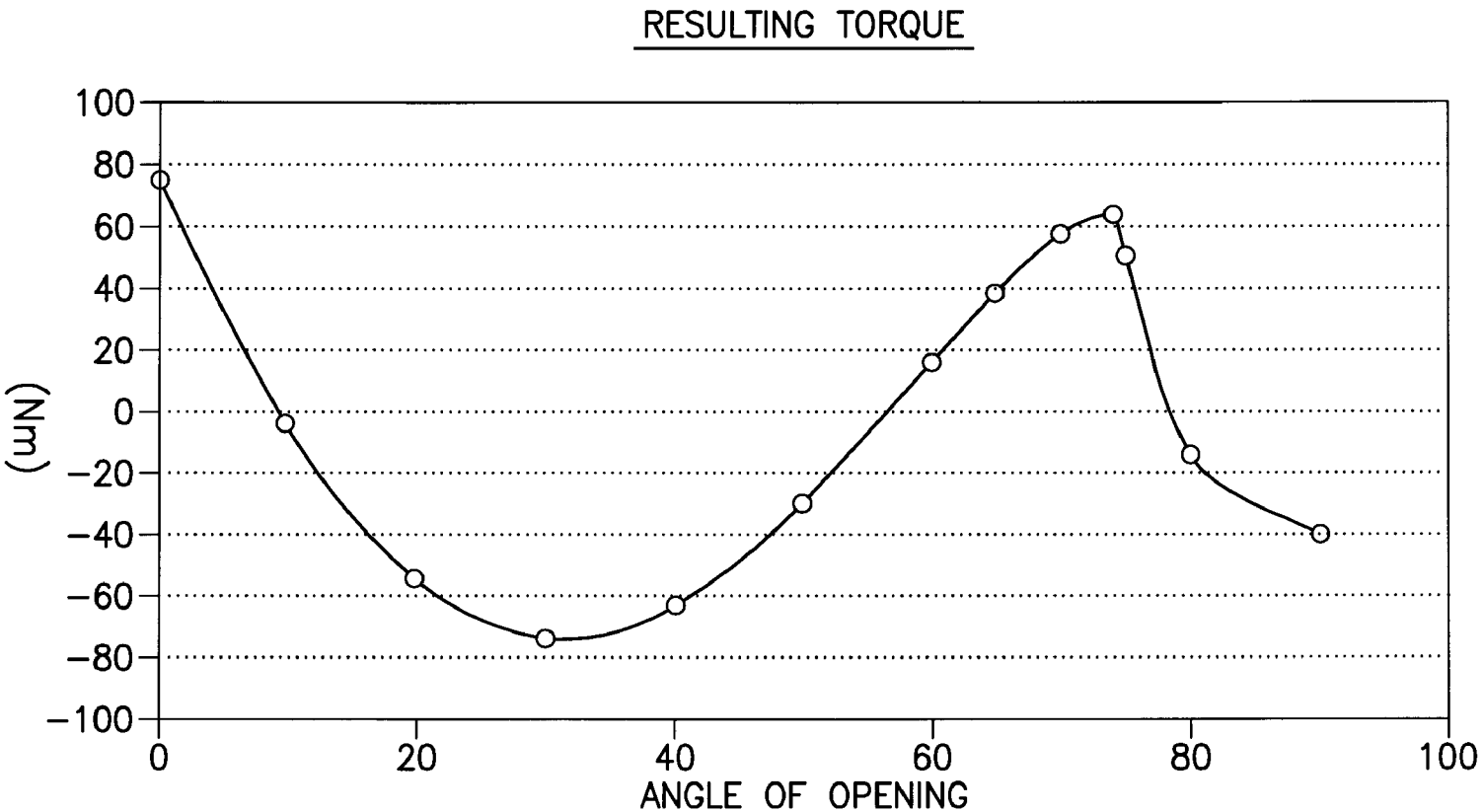

FIG. 10 shows the torque affecting the lid resulting from gravity and from the spring mechanism, respectively, as a function of the opening angle of the lid, where 0° is the closed position of the lid and approximately 90° is the open position. It should be understood that the two torques are mutually oppositely directed. FIG. 11 shows the resulting torque and it should be noted that a positive torque will rotate the lid towards the closed position and a negative torque will rotate the lid towards the open position.

Figure 5:
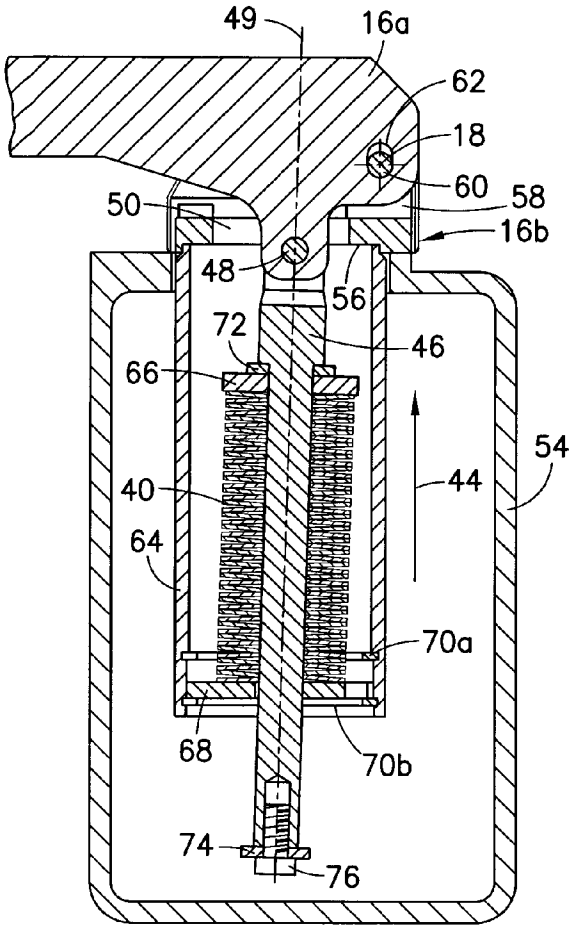

As it appears from FIGS. 10 and 11, in the FIG. 5-*situation*, where the opening angle is 0°, the torque resulting from gravity is larger than the torque resulting from the spring mechanism and the lid stays in the closed position until raised by an operator.

When the lid is raised to approximately 10° the torque resulting from the spring exceeds the torque resulting from gravity and the spring raises the lid further. It is seen that the torques are not linear functions of the opening angle. This is due to the rotary movement of the lid 14 and the hinge point 48, respectively, around the hinge axis 18, and for the torque resulting from the spring mechanism it is further due to an inherent non-linearity of a Belleville washer spring like the spring 40.

Figure 6:
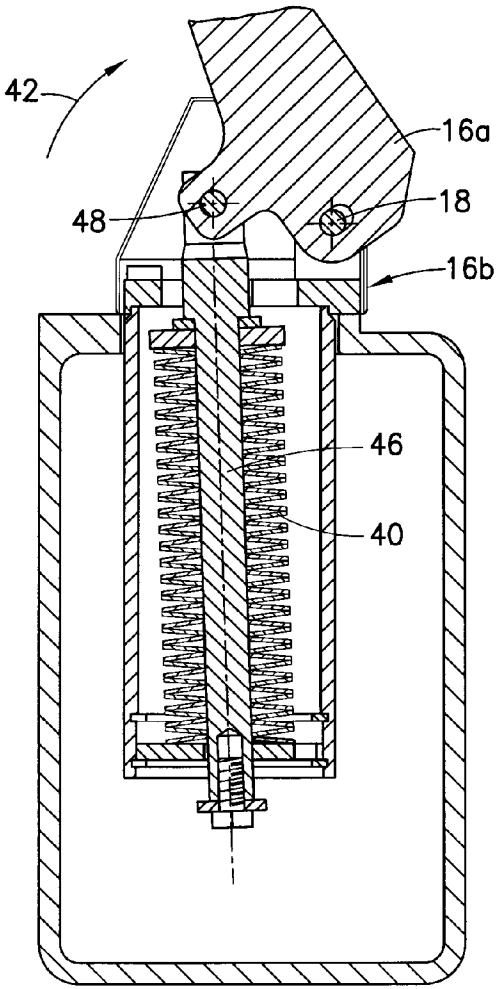
FIGS. 5 to 9 show an embodiment of a hinge and spring construction according to the present invention with different angular positions of the lid from closed position to fully opened position.

In FIG. 6 the lid 14 has been raised approximately 55° around the hinge axis 18, the rod 46 has been raised relative to its position in FIG. 5, and the spring 40 has been stretched correspondingly, though it is still, but less, compressed. In this position the torques resulting from gravity and from the spring are (again) approximately equal but oppositely directed, as it appears from FIGS. 10 and 11. Thus the lid 14 has a position of equilibrium at this point. Since lowering the lid from this position will result in a resulting negative torque tending to raise the lid and raising lid will result in a positive resulting torque tending to lower the lid it is seen that this position of equilibrium is stable.

Figure 7:
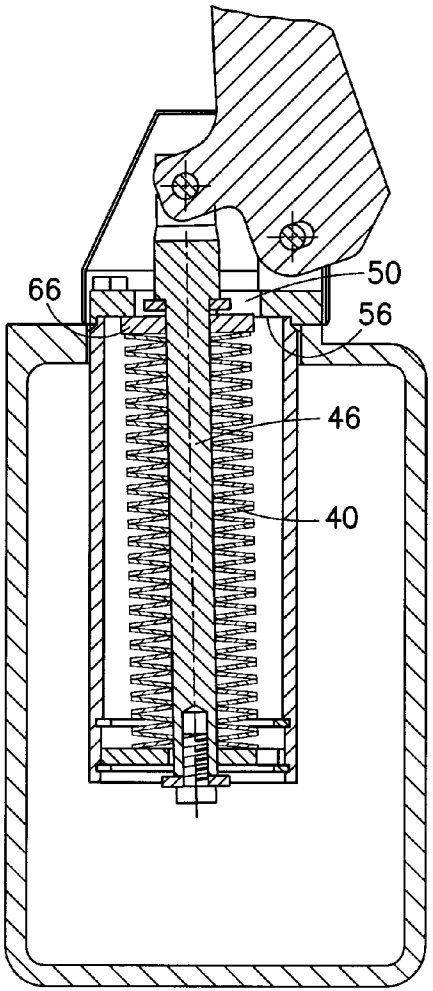

In FIG. 7 the lid is raised to approximately 70° and the upper washer element 66 abuts the edges of the elongate hole 50 in the flat member 56. Thus from this point the spring 40 is not able to urge the rod 46 further towards the (fully) open position.

Figure 8:
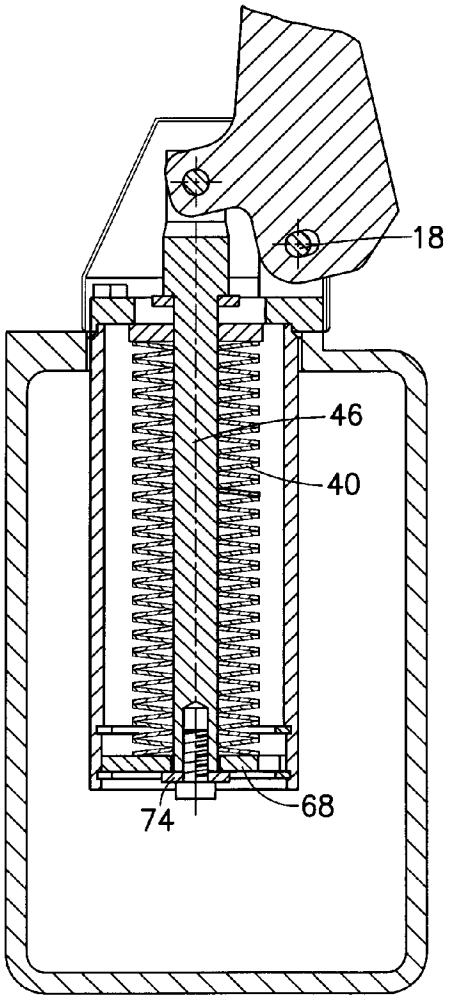

In FIG. 8 the lid is raised to approximately 80° and the lower retaining washer 74 now abuts the lower washer element 68. Thus between the FIG. 7-*situation* and the FIG. 8-*situation* the spring 40 and the rod 46 have not been affecting each other, but at further rotation around the hinge axis 18 of the lid 14 the rod 46 starts to compress the spring 40 from below through the lower retaining washer 74 and the lower washer element 68.

It is seen that between the FIG. 7-*situation* and the FIG. 8-*situation* the spring 40 is in a neutral position in the sense that it is not affecting the rod 46, however it may still be compressed to a certain degree.

Approximately at 80° the lid 14 has a position of (instable) equilibrium relative to gravity i.e. the centre of gravity is placed vertically above the hinge axis 18.

Figure 9:
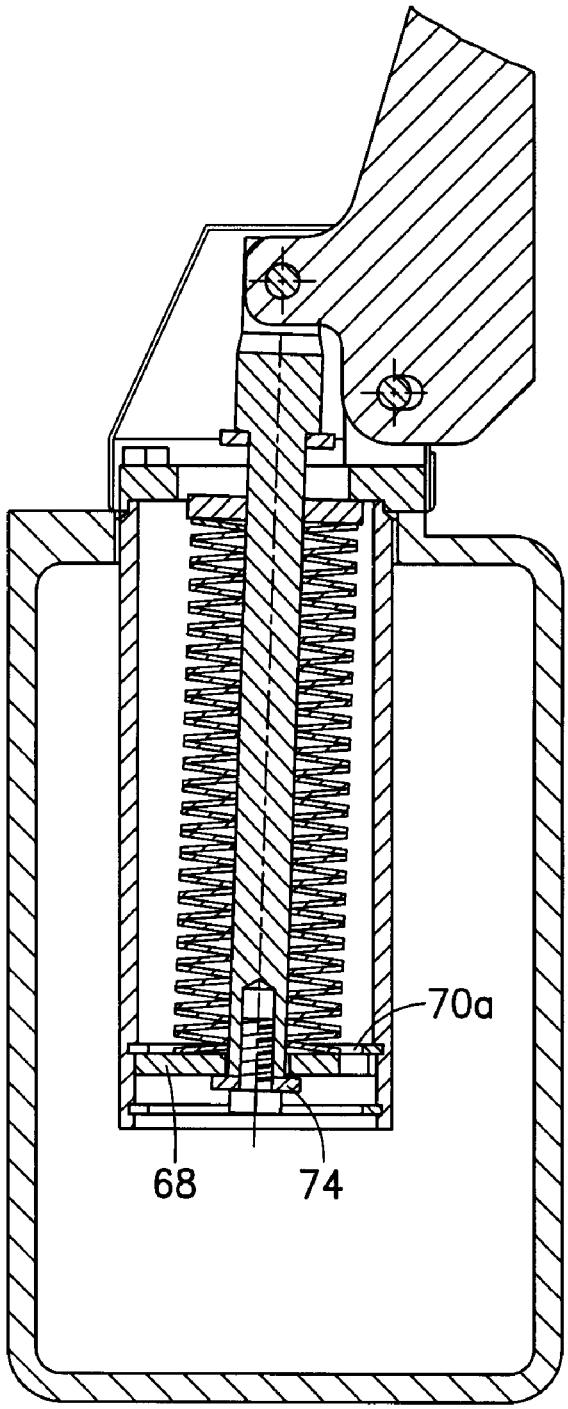

In FIG. 9 the lid is raised to approximately 90° and the rod 46 has through the lower retaining washer 74 raised the lower washer element 68 compressing the spring 40, which thus urges the rod 46 in a direction opposite the longitudinal direction 44, and thereby affects the lid 14 with a torque directed towards the closed position of the lid. The torque thus imposed by the spring 40 is however smaller than the torque imposed by gravity, which now tends to raise the lid still further. However at this point the lower washer element 68 abuts on the upper retainer ring 70*a* and restricts further movement of the lid. Thus the upper retainer ring 70*a* establishes the open position of the lid.

It is seen that when an operator opens the lid 14 by grapping the handle 36, the spring 40 assists opening the lid 14 from 0° to approximately 10°. From approximately 10° the spring 40 will open the lid up to approximately 55°. From approximately 55° to approximately 70° the operator needs to apply force to the handle 36 to raise the lid but he or she will be assisted by the spring 40. From approximately 70° to 80° the operator will not be assisted by the spring, but on the other hand the lid 14 will be close to equilibrium regarding gravity and assistance from the spring is not needed at this time. From approximately 80°gravity will open the lid completely, but the spring 40 will reduce the resulting torque to ensure that the stop provided by the upper retainer ring 70*a* is not hit too violently.

When the operator wish to close the lid 14, he or she will be assisted by the spring 40 in rotating the lid 14 from the open position at approximately 90° to approximately 80°when the torque resulting from gravity reverses and tends to close the lid. Should the operator loose the grip of the handle 36 the lid will not fall to the closed position, with the risk of jamming arms or feet of the operator, but it will be caught at the stable equilibrium position at approximately 55°.

Not until the position of approximately 10° is reached will the lid tend to rotate to the closed position. When the lid 14 has reached the closed position the resulting torque will tend to keep it there while the operator secures the lid 14 by means of screws (not shown) inserted through the holes in the brackets 32 and screw into the holes 34 in the lower part 12 of the housing. When tightening the fastener screws the gasket at the rim 30 of the lid 14 is compressed the elongate hole in the first hinge part 16*a* allowing the lid 14 to be shifted vertically downwards when in the closed position. On the other hand rotating the lid 14 to its closed position will not entail a compression of the gasket, which will not interfere with the action of the spring 40.

Figure 12:
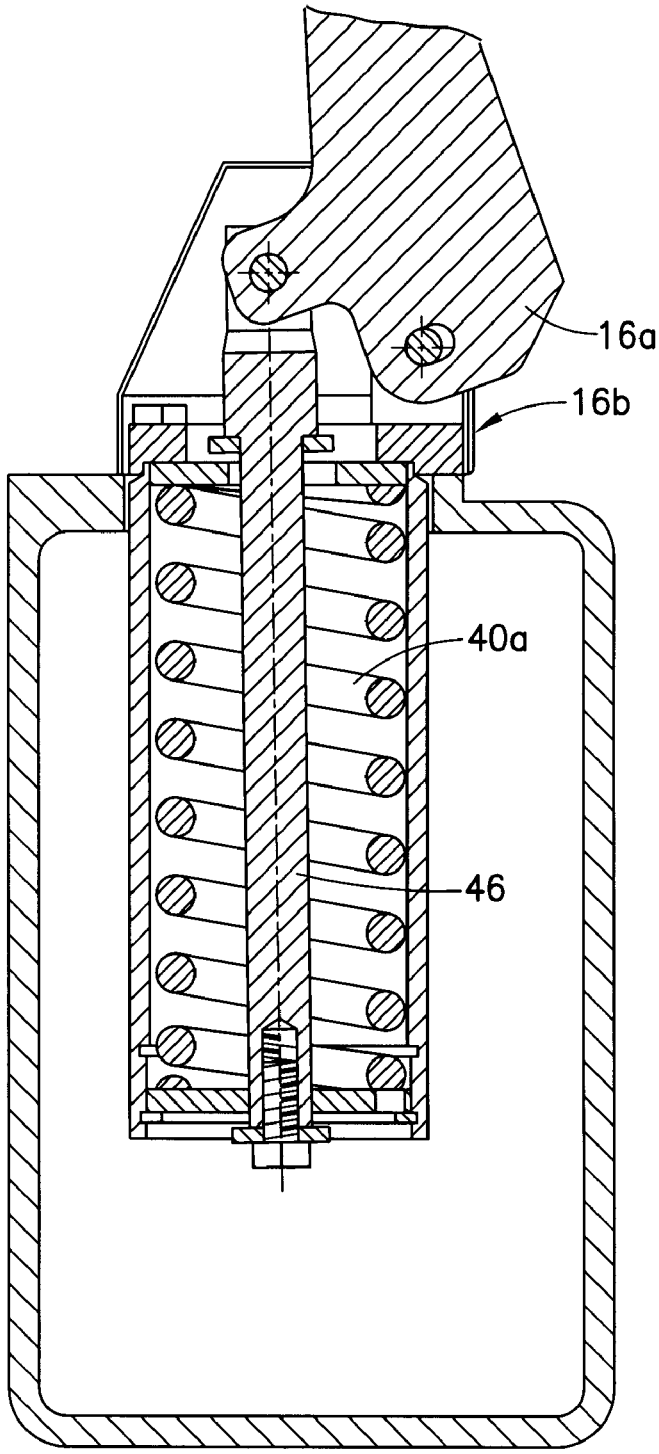
FIG. 12 shows the embodiment of FIGS. 5 to 9 with an alternative spring unit.

FIG. 12 shows an embodiment, which is identical to the embodiment shown in FIGS. 5-9 except for fact, that the spring unit is a cylindrical coil spring 40*a* rather than a stack of Belleville washers. This embodiment works in generally the same way as the embodiment shown in FIGS. 5 to 9, though the characteristic of the spring 40*a* is not identical to the characteristic of the stack of Belleville washers 40

Figure 13:
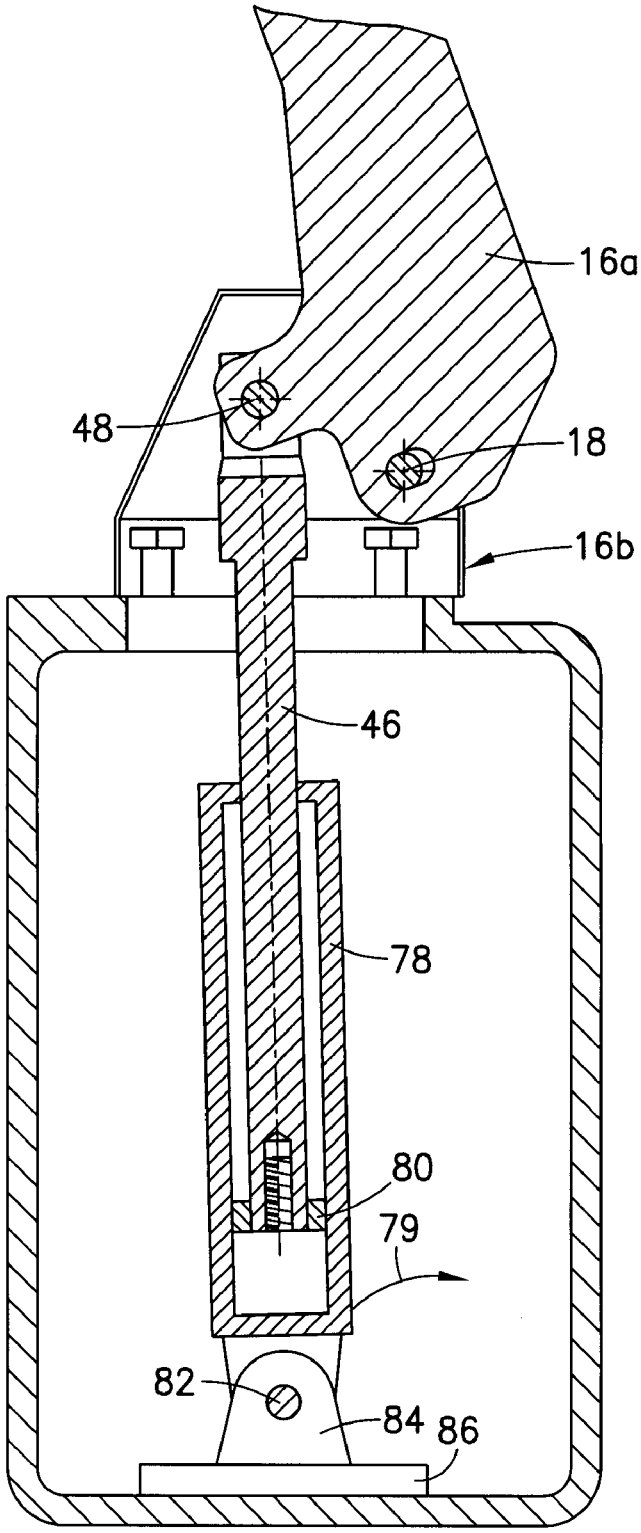
FIG. 13 shows an alternative hinge and spring construction according to the present invention.

FIG. 13 shows an embodiment in which a hydraulic cylinder 78 connected, as indicated at 78, with an accumulator is used as a spring unit. Parts identical to parts shown and explained in relation to FIGS. 5 to 9 are given corresponding numerals. In this embodiment the rod 46 is attached to a piston 80 of the hydraulic cylinder 78, which is fastened rotatably to the bottom of the hollow beam 54 by means of pivot 82 inserted through a rising lobe 84 of an attachment member 86.

The embodiment of FIG. 13 works in the way that when the lid is raised from the closed position the hydraulic cylinder 78, acting as a spring, will, like the former embodiments, assist the raising to a point when the pressure in the hydraulic cylinder 78 has reached equilibrium, e.g. when the lid has been raised 80°. Thereafter the spring effect of the hydraulic cylinder 78 will reverse the pressure in the cylinder still getting lower due to the piston being pulled up by the rod 46 at continued rotation of the first hinge part 16*a* around the hinge axis 18. Thus when the lid has reached its open position the hydraulic cylinder 78 will impose a torque on the lid tending to rotate the lid towards its closed position.

It should be understood that although herein a hinge or hinges are mentioned to be connecting the lid 14 with the lower part 12, and a spring or spring unit is mentioned to be attached to a hinge, one or more hinges may be used to provided for proper guidance of the lid during its rotation between the closed and the open position, as it is known in the art, and one or more of such hinges may have a spring attached. Further when one spring is mentioned it should be under stood that such spring could comprise system of springs or spring units working in parallel. And still further it should be understood that the elements of the hinge and the spring might be spaced along the hinge axis when the spring is connected to elements rigidly connected to the relevant elements of the hinge rather than being directly connected to the respective elements of the hinge.

What is claimed is:

1. A centrifuge comprising a drum with an axis of rotation and a housing for the drum, said housing comprising a lower part and a lid, the lid being attached to the lower part by at least one hinge comprising two hinge parts one of which is connected to the lid and one of which is connected to the lower part, said hinge having a horizontal hinge axis, whereby the lid is able to rotate around the hinge axis between a closed position, in which a centre of gravity of the lid is positioned on a proximal side of a vertical plane through the hinge axis, and a fully opened position, in which the centre of gravity is positioned on a distal side of the vertical plane through the hinge axis, the lid being provided with a handle for manually opening the lid, at least one spring unit being attached to the hinge for assisting raising of the lid during opening, the spring unit being a longitudinal spring unit having a longitudinal direction, the spring unit being connected to a connection member for urging the connection member in the longitudinal direction, the connection member being connected to one of the hinge parts at a hinge point at a distance from the hinge axis, the spring unit having a neutral extension in which it is not urging the connection member in the longitudinal direction, when the lid is in an intermediate position between its closed position and its fully opened position, the spring unit being stressed away from its neutral extension to urge the connection member in the longitudinal direction and thus the lid in a direction towards the fully opened position, when the lid is in the closed position, wherein the connection member is connected to the spring unit to stress it during at least a final part of the lids rotation around the hinge axis to the fully opened position, whereby the spring unit will urge the lid through the connection member in a direction from the fully opened position towards the closed position, when the lid is in the fully opened position, and wherein the lid has a position of stable equilibrium in an intermediate position of the lid between the closed position and a vertical position, in which the centre of gravity is positioned vertically above the hinge axis.

2. A centrifuge according to claim 1, wherein the centrifuge is a decanter centrifuge and the drum has a horizontal axis of rotation.

3. A centrifuge according to claim 1, wherein at least a part of the connection member connected to the hinge part is shiftable between limits relative to a force transferring interface between the connection member and the spring unit, when the spring unit is in a position, in which it has its neutral extension.

4. A centrifuge according to claim 1, wherein a vertical plane parallel to the hinge axis and passing through the hinge point, when the lid is in its closed position, is located between the centre of gravity of the lid and the hinge axis, and wherein the hinge allows limited vertical movement of the lid in the closed position.

5. A centrifuge according to claim 1, wherein the spring unit is a mechanical spring unit, the connection member extends beyond a longitudinal extension of the spring unit, the spring unit is confined at its longitudinal ends between first abutments, which are fixed relative to the second of the hinge parts, and wherein the connection member comprises second abutments for compressing the spring unit from either longitudinal end thereof.

6. A centrifuge according to claim 5, wherein the mutual distances between the first abutments and the second abutments, respectively, are different.

7. A centrifuge according to claim 5, wherein a washer element is provided at one of the longitudinal ends of the spring unit, the spring unit abutting the washer element, the connection member is passing through the washer element, the connection member being longitudinally slidable relative to the washer element, a second abutment is engageable with the washer element, and wherein a stop is provided restricting movement of the washer element in a longitudinal direction away from the spring unit, the stop thus providing a first abutment.

8. A centrifuge according to claim 7, wherein a washer element is provided at either longitudinal end of the spring unit.

9. A centrifuge according to claim 7, wherein the washer element at the longitudinal end of the spring unit opposite the hinge point is movable in the longitudinal direction between two stops.

10. A centrifuge according to claim 1, wherein the spring unit is hollow, and the connection member extends through the spring unit.

11. A centrifuge according to claim 10, wherein the spring unit comprises a stack of Belleville washers.

12. A centrifuge according to claim 1, wherein the connection member is connected to a piston of a pneumatic or hydraulic cylinder assembly providing the spring unit.

* * * * *